US009668075B2

(12) United States Patent
Iyer

(10) Patent No.: US 9,668,075 B2
(45) Date of Patent: May 30, 2017

(54) ESTIMATING PARAMETER VALUES FOR A LUMPED PARAMETER MODEL OF A LOUDSPEAKER

(71) Applicant: HARMAN INTERNATIONAL INDUSTRIES, INC., Stamford, CT (US)

(72) Inventor: Ajay Iyer, Murray, UT (US)

(73) Assignee: HARMAN INTERNATIONAL INDUSTRIES, INC., Stamford, CT (US)

( * ) Notice: Subject to any disclaimer, the term of this patent is extended or adjusted under 35 U.S.C. 154(b) by 0 days.

(21) Appl. No.: 14/739,852

(22) Filed: Jun. 15, 2015

(65) Prior Publication Data

US 2016/0366529 A1 Dec. 15, 2016

(51) Int. Cl.
*H04R 29/00* (2006.01)
*G10L 25/30* (2013.01)

(52) U.S. Cl.
CPC ..... *H04R 29/001* (2013.01); *G10L 25/30* (2013.01)

(58) Field of Classification Search
CPC ..... H04R 29/001; G10L 25/30
USPC ..... 379/406.06, 420.01, 88.01; 381/55, 59, 381/71.11, 96, 98, 182, 333; 700/245, 700/109, 287; 340/815.4; 356/73; 382/155; 429/428; 701/1; 702/85; 704/232, 249; 705/2, 7.29; 706/20
See application file for complete search history.

(56) References Cited

U.S. PATENT DOCUMENTS 5,438,625 A * 8/1995 Klippel ..... H04R 3/002 381/59
5,600,718 A * 2/1997 Dent ..... H04R 3/002 379/400
5,790,754 A * 8/1998 Mozer ..... G10L 15/16 704/232
5,815,585 A * 9/1998 Klippel ..... H03H 21/0001 381/59
6,005,952 A * 12/1999 Klippel ..... G10K 11/178 381/71.11
6,665,377 B1 * 12/2003 McKinley, Jr. ... H04M 3/42204 379/201.02

(Continued)

OTHER PUBLICATIONS

Hu, et al., "Parameter Estimation in Nonlinear Systems Using Hopfield Neural Networks", 37 pages. No Date.

*Primary Examiner* — Gerald Gauthier
(74) *Attorney, Agent, or Firm* — Artegis Law Group, LLP

(57) ABSTRACT

In one embodiment of the present invention, a loudspeaker parameter estimation subsystem efficiently and accurately estimates parameter values for a lumped parameter model (LPM) of a loudspeaker. In operation, the loudspeaker parameter estimation subsystem trains a neural network model based on responses generated via the lumped parameter model and the corresponding sets of parameter values. Subsequently, based on the relationship between the measured output response of a loudspeaker to an input stimulus, the loudspeaker parameter estimation subsystem estimates parameter values for the LPM of the loudspeaker. Advantageously, by sagaciously estimating parameter values for the LPM of loudspeakers, these NN-based techniques enable designers to leverage the LPM to reliably improve the design of loudspeakers, perform nonlinear correction of loudspeakers, and the like.

20 Claims, 6 Drawing Sheets

(56) References Cited

U.S. PATENT DOCUMENTS

| | | | | |
|---|---|---|---|---|
| 7,352,859 | B2 * | 4/2008 | Dedieu | H04M 1/03 379/420.01 |
| 8,180,076 | B2 * | 5/2012 | Bastyr | H04R 1/2888 381/182 |
| 2009/0262967 | A1 * | 10/2009 | Bryan | H04R 5/02 381/333 |
| 2012/0109375 | A1 * | 5/2012 | Hallam | H04R 3/005 700/245 |
| 2012/0226967 | A1 * | 9/2012 | Oh | G06F 8/35 715/205 |
| 2013/0013993 | A1 * | 1/2013 | Oh | G06F 17/5009 715/212 |
| 2014/0098965 | A1 * | 4/2014 | Wang | H04R 29/001 381/59 |
| 2014/0195236 | A1 * | 7/2014 | Hosom | G10L 17/18 704/249 |
| 2014/0214417 | A1 * | 7/2014 | Wang | G10L 17/18 704/232 |
| 2015/0201294 | A1 * | 7/2015 | Risberg | H04R 3/002 381/59 |
| 2015/0249889 | A1 * | 9/2015 | Iyer | H04R 3/08 381/98 |
| 2015/0304772 | A1 * | 10/2015 | Risberg | H04R 3/007 381/55 |
| 2016/0134982 | A1 * | 5/2016 | Iyer | H04R 29/001 381/59 |
| 2016/0323685 | A1 * | 11/2016 | Iyer | H04R 29/001 |
| 2016/0366529 | A1 * | 12/2016 | Iyer | G10L 25/30 |

* cited by examiner

ESTIMATING PARAMETER VALUES FOR A LUMPED PARAMETER MODEL OF A LOUDSPEAKER

BACKGROUND

Field of the Invention

Embodiments of the present invention relate generally to analyzing loudspeaker systems and, more specifically, to estimating parameter values for a lumped parameter model of a loudspeaker.

Description of the Related Art

Modeling the behavior of one or more loudspeakers is a typical step when analyzing and/or designing an audio system. For example, a designer may perform several computer simulations of a loudspeaker based on a model of the loudspeaker to better understand the behavior and characteristics of the loudspeaker within the overall audio system being analyzed and/or designed.

One well-known type of model that is oftentimes employed when running such computer simulations is the lumped parameter model. In general, the lumped parameter model of a loudspeaker includes values of a set of parameters that, together, approximate the behavior of the loudspeaker. The parameters and the values of those parameters used in the lumped parameter model reflect simplifying assumptions, such as a piston-like motion of the loudspeaker diaphragm, that enable simplified mathematical modeling of the components within the loudspeaker and, consequently, more efficient simulation of the loudspeaker.

In general, lumped parameter models are capable of providing a level of accuracy that is acceptable for modeling many aspects of actual loudspeaker behavior. However, the accuracy of a lumped parameter model of a given loudspeaker is largely dependent on the accuracy of the values of the parameters used in the lumped parameter model. Directly measuring the "correct" values of the different parameters a lumped parameter model of a loudspeaker is typically impractical and/or inaccurate. For example directly measuring certain parameters can damage the loudspeaker or can perturb the loudspeaker, which can corrupt the measurement. Accordingly, designers employ a variety of techniques to estimate the values of the parameters used in lumped parameter models of loudspeakers.

One widely-used technique is based on measurements obtained via a Klippel Analyzer—a device that analyzes speakers while in motion. Although the accuracy of measurements obtained via the Klippel Analyzer is normally acceptable, for certain design processes, such as developing model-based nonlinear correctors, greater accuracy may be desired. In general, other current techniques for estimating the values of the parameters used in the lumped parameter model of a given loudspeaker are similarly limited and, consequently, are inadequate for many design processes that require a high level of modeling accuracy.

As the foregoing illustrates, more effective techniques for estimating lumped parameter values for loudspeaker models would be useful.

SUMMARY

One embodiment of the present invention sets forth a computer-implemented method for estimating a set of parameter values for a lumped parameter model of a loudspeaker. The method includes receiving an audio input signal and a measured response of a loudspeaker that corresponds to the audio input signal; and generating via a neural network model a set of parameter values for the lumped parameter model of the loudspeaker based on the audio input signal and the measured response, where the behavior of the first neural network model is tuned according to a plurality of model responses generated via the lumped parameter model based on varying sets of parameter values.

Further embodiments provide, among other things, a system and a non-transitory computer-readable medium configured to implement the method set forth above.

At least one advantage of the disclosed techniques is that they enable both efficient and accurate simulation of the behavior of loudspeaker systems. More specifically, by leveraging a neural network model to estimate parameter values for lumped parameter models of loudspeakers, the disclosed techniques enable more accurate and reliable lumped parameter model based analysis of loudspeakers than is facilitated using conventional estimation techniques for parameter values.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

In the following description, numerous specific details are set forth to provide a more thorough understanding of the present invention. However, it will be apparent to one of skill in the art that the present invention may be practiced without one or more of these specific details.

Loudspeaker Parameter Estimation System

Figure 1:
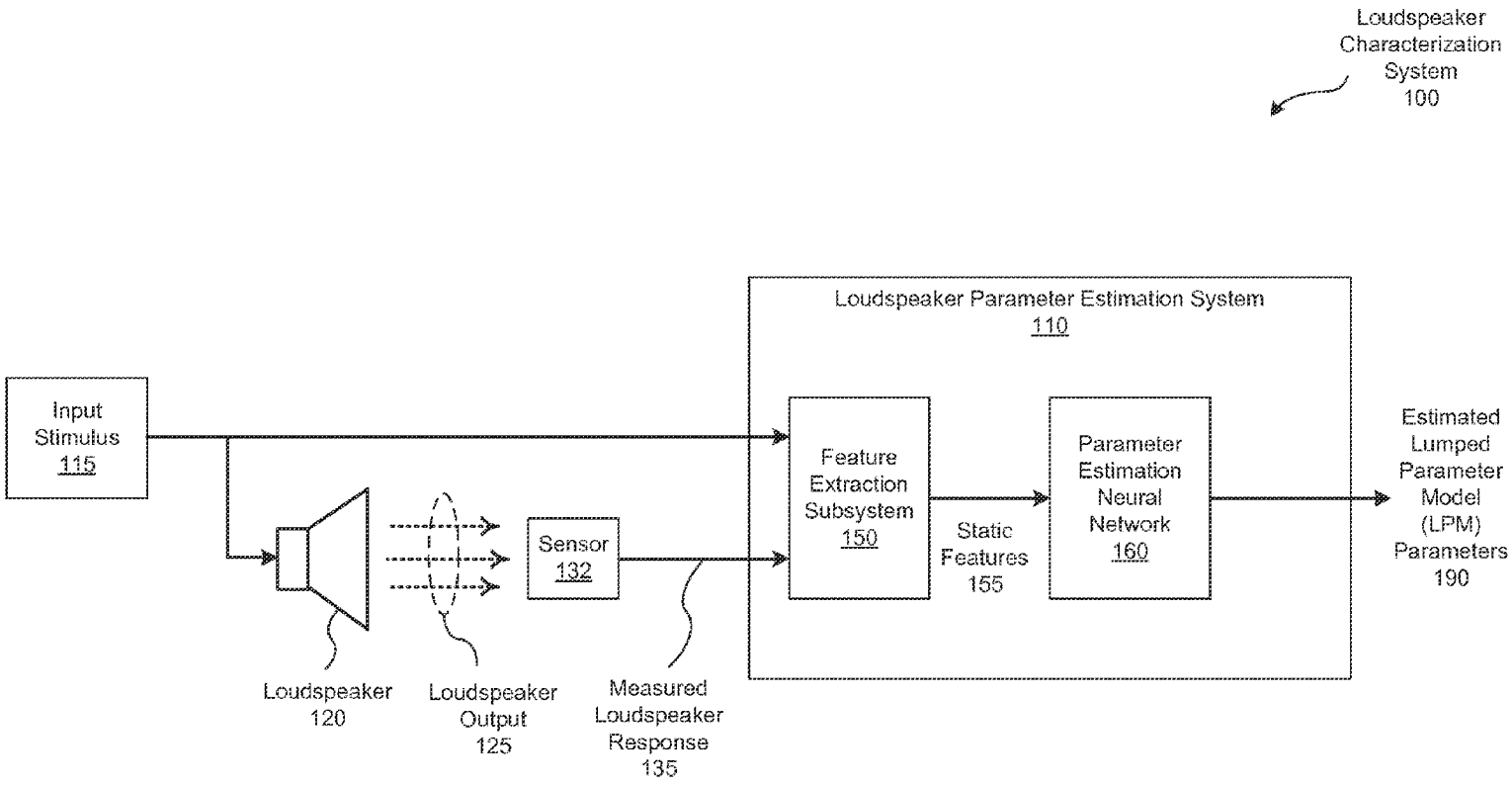
FIG. 1 illustrates a loudspeaker characterization system configured to implement one or more aspects of the various embodiments.

FIG. 1 illustrates a loudspeaker characterization system 100 configured to implement one or more aspects of the various embodiments. As shown, the loudspeaker characterization system 100 includes, without limitation, input stimulus 115, the loudspeaker 120, a sensor 132, and a loudspeaker parameter estimation system 100. As also shown, the loudspeaker parameter estimation system 110 includes a feature extraction subsystem 150 and a parameter estimation neural network (NN) 160. Notably, the loudspeaker parameter estimation system 110 is configured to estimate the parameters values for a lumped parameter model (LPM) of a loudspeaker 120 more reliably and more accurately than conventional approaches to parameter value estimation.

The loudspeaker 120 transforms the input stimulus 115 (i.e., an electrical audio signal) into a loudspeaker output 125—sounds. The loudspeaker 120 may be implemented in any technically feasible fashion. For example, and without limitation, in some embodiments the loudspeaker 120 may be a "horn" loudspeaker. Alternatively, and without limitation, in some embodiments the loudspeaker 120 may be a "direct radiating" loudspeaker. In a complementary fashion, the sensor 132 transforms the loudspeaker output 125 into measured loudspeaker response 135—an electrical signal that "measures" one or more characteristics of the loudspeaker output 125. For example, and without limitation, in some embodiments the sensor 132 may be a microphone and the measured loudspeaker response 135 may be an electrical audio signal.

In alternate embodiments, the loudspeaker 120 and the sensor 132 may be replaced by any number of units that emulate the output of a hypothetical loudspeaker with at least an acceptable level of accuracy. For example, and without limitation, in alternate embodiments, the loudspeaker 120 and the sensor 132 may be omitted and the loudspeaker parameter estimation system 110 may be configured to perform computationally-intensive calculations, such as finite element analysis calculations, to fabricate "sensor data" that represents the response of a potential next-generation loudspeaker to the input stimulus 115.

Notably, the measured loudspeaker response 135 is a function of both the input stimulus 115 and time (i.e., the loudspeaker response 135 is "dynamical"). By contrast, as persons skilled in the art will recognize, the parameter values for the lumped parameter model are typically static (i.e., do not vary with time). For this reason, the feature extraction subsystem 150 is configured to convert dynamical information included in the transfer function of the loudspeaker into static features 155. As used herein, "transfer function" refers to some characteristic of the relationship between an input and an output of a system, such as the loudspeaker 120, the lumped parameter model, etc. The feature extraction subsystem 150 may be implemented in any technically feasible fashion, and the static features 155 may be any type of static data that reflects the relevant dynamical information included in a transfer function of the loudspeaker 120.

For example, and without limitation, in some embodiments, the feature extraction subsystem 150 may leverage a recurrent neural network (RNN) (i.e., a neural network that operates in time and is well-suited for modeling nonlinear dynamical systems) to efficiently extract the static features 155. More specifically, the feature extraction subsystem 150 may include a RNN, and the loudspeaker parameter estimation system 110 may train the RNN to generate the audio input 110 in response to the measured loudspeaker response 135. After training, the static parameter values of for the RNN accurately represent dynamical system information that relates the input stimulus 115 to the measured loudspeaker response 135. Notably, unlike the parameters typically used in the lumped parameter model, the parameters used in the RNN do not necessarily have any physical significance.

In alternate embodiments, without limitation, the feature extraction subsystem 150 may perform, without limitation, any number of short time Fourier transforms, cepstral transforms, wavelet transforms, Hilbert transforms, recurrent neural network modelling operations, linear/nonlinear principal component analyses, and distortion analyses to generate the static features 155 based on a transfer function of the lumped parameter model.

Upon receiving the static features 155, the parameter estimation neural network 160 generates estimated lumped parameter model (LPM) parameters 190 that, when used as the values of the parameters of the LPM, enable the LPM to accurately model the behavior of the loudspeaker 120. As used herein, "estimated LPM parameters" is a set of parameter values for the LPM to produce an input/output relationship of the LPM, such as the transfer function described by the static features 155. The loudspeaker parameter estimation system 110 generates the parameter estimation neural network 160 during a "training" phase that precedes the operation of the loudspeaker parameter estimation system 110 in the "parameter estimating" configuration depicted in FIG. 1. This training phase is described in greater detail below in FIGS. 2 and 3.

In general, during the training phase, the loudspeaker parameter estimation system 100 is configured to train the parameter estimation neural network 160 to map a "space" of measured loudspeaker responses 135 to a "space" of sets of parameter values for the LPM that configure the LPM to estimate those measured loudspeaker responses 135. Such a mapping is typically more comprehensive than mappings generated via conventional parameter estimation techniques, such as techniques that rely on the Klippel Analyzer. Consequently, the estimated LPM parameters 190 are typically significantly more accurate than the parameter values for the LPM that are estimated using conventional parameter estimation techniques.

Training the Parameter Estimation Neural Network

Figure 2:
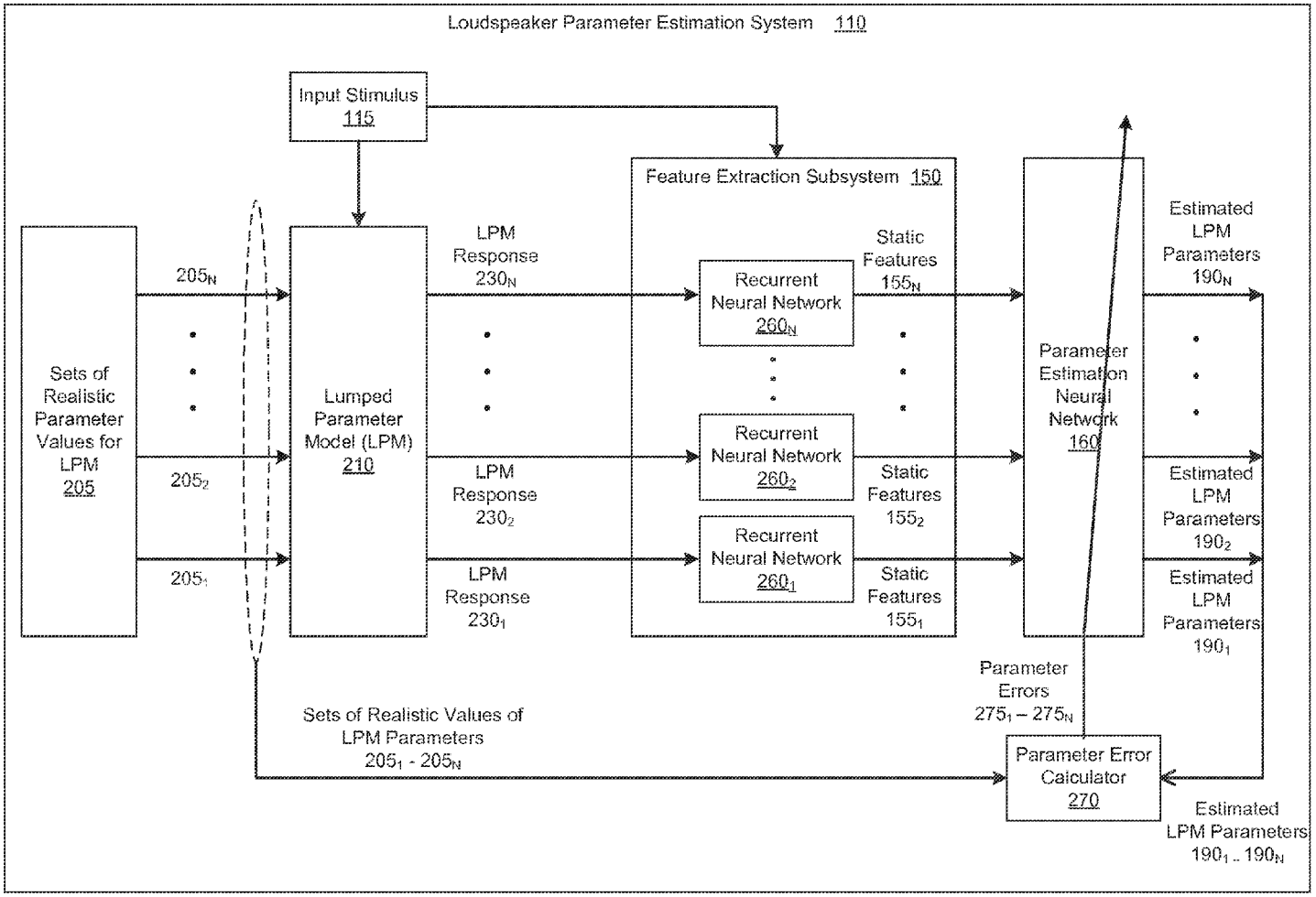
FIG. 2 is a more detailed illustration of the loudspeaker parameter estimation system of FIG. 1 showing how to train the parameter estimation neural network (NN), according to various embodiments.

FIG. 2 is a more detailed illustration of the loudspeaker parameter estimation system 110 of FIG. 1 showing how to train the parameter estimation neural network (NN) 160, according to various embodiments. More specifically, the loudspeaker parameter estimation system 110 is configured to train the parameter estimation neural network (NN) 160 to generate the estimated lumped parameter model parameters 190 for any given loudspeaker, including the loudspeaker 120. As shown, the loudspeaker parameter estimation system 110 includes, without limitation, the input stimulus 115, sets of realistic parameter values for LPM 205, a lumped parameter model (LPM) 210, a feature extraction subsystem 150, the parameter estimation neural network (NN) 160, and a parameter error calculator 270.

As shown, the input stimulus 115 is an input to the LPM 210. Since the LPM 210 is used for nonlinear modeling of loudspeakers, it is often difficult to fully characterize the nonlinear system (i.e., the loudspeaker behavior modeled by the LPM 210) using a single stimulus. For instance, and without limitation, if a single sine tone (frequency f) were used as input to a nonlinear system, then the output would contain the harmonic frequencies (2*f, 3*f, 4*f, so on). By contrast, and without limitation, if two tones (frequencies $f_1$ and $f_2$) were used as input to the nonlinear system, then the output would contain the sum and difference of those frequencies (i.e., $f_1+f_2$, $f_1+2*f_2$, $f_1-f_2$, $f_1-2*f_2$, . . . ) and the individual harmonic frequencies (i.e., $2*f_1$, $3*f_1$, . . . and $2*f_2$, $3*f_2$, . . . ). Consequently, to fully excite the complete nonlinear behavior of the LPM 210, the input stimulus 115 may include a combination of different stimuli. For example, and without limitation, in some embodiments, the input stimulus 115 may include different types and levels of music, square waves, Farina Sweeps, Mutitones (i.e., more than two tones), and Pink Noise, in any combination.

In some embodiments, the input stimulus 115 used for training the parameter estimation NN 160 may differ from the input stimulus 115 used to estimate the parameters of the LPM 210 of the loudspeaker 120. In such embodiments, the input stimulus 115 used for training the parameter estimation NN 160 may be designed for simulation purposes as part of analyzing the LPM 210, and may not be designed to measure "actual" loudspeaker behavior.

As also shown, the sets of realistic parameter values for LPM 205 are inputs to the LPM 210. The sets of realistic values for LPM parameters 205 are sets of different parameter values for the LPM 210 that the loudspeaker parameter estimation system 110 uses to analyze the LPM 210. For explanatory purposes, the $i^{th}$ set included in the sets of realistic parameter values for LPM 205 is referred to herein as the set of realistic parameter values for LPM $\mathbf{205}_i$ and is associated with the LPM response $\mathbf{230}_i$, a RNN $\mathbf{260}_i$, and the static features $\mathbf{155}_i$.

As used herein, "realistic parameter values for LPM" refers to a set of values of the parameters of the LPM 210 that is physically realistic and does not "break" the LPM 210 (i.e., cause undesirable modeling behavior). For instance, and without limitation, the set of realistic parameter values for LPM $\mathbf{205}_i$ would typically not include a polynomial for the force factor that is ill-conditioned or a value of DC voice coil resistance that is negative. In alternate embodiments, for each of the sets of realistic parameter values for LPM $\mathbf{205}_i$, the loudspeaker parameter estimation system 110 may scale the input stimulus to a different level (because, for instance, and without limitation, for a 6 inch driver the maximum root mean square (RMS) input may be 28.3 volts, while for a 3 inch driver the maximum RMS may be 11.2 volts RMS).

The loudspeaker parameter estimation system 110 may generate the sets of realistic parameter values for LPM 205 in any technically feasible fashion. In some embodiments, without limitation, the sets of realistic vales of LPM parameters 205 may be parameter sets for different transducers (e.g., Klippel parameter sets) that may be determined in any fashion as known in the art, such as measured using the Klippel Analyzer. In other embodiments, the loudspeaker parameter estimation system 110 may estimate the sets of realistic parameter values for LPM 205 using adaptive algorithms and/or measurements. In other words, existing lumped parameter estimates of a loudspeaker may be further refined using the techniques disclosed herein.

The LPM 210 models loudspeaker behavior based on the parameter values for the LPM 210. The LPM 210 may be defined in any technically feasible fashion and may include any number and type of parameters that are consistent with the definition of the LPM 210. For example, in one embodiment, without limitation, the LPM 210 may implement a set of equations, and the parameters used in the LPM 210 may include, without limitation: coefficients of force factor Bl(x), stiffness $K_{ms}(x)$, and voice coil inductance $L_e(x)$ polynomials, cone surface area $S_d$, mechanical resistance $R_{ms}$, voice coil DC resistance $R_e$ total moving mass $M_{ms}$, para-inductance $L_2$ (x), para-resistance $R_2(x)$, and flux modulation $L_e$. One example, without limitation, of a set of such equations is:

$$G_t(t) = iR_{vc} + \frac{d(iL_e(x, i))}{dt} + \frac{d(i_2L_2(x, i))}{dt} + Bl(x)v \quad 1)$$

$$Bl(x)i = vR_{ms} + K_{tot}(x)x + M_{tot}\frac{dv}{dt} + F_m(x, i, i_2) \quad 2)$$

$$F_m(x, i, i_2) = -\frac{i^2}{2}\frac{\partial(L_e(x, i))}{\partial x} - \frac{i_2^2}{2}\frac{\partial(L_2(x, i))}{\partial x} \quad 3)$$

$$p(t) = \frac{d^2(x(t))}{dt^2} \quad 4)$$

In operation, the loudspeaker parameter estimation system 110 sets the parameter values for the LPM 210 multiple times—once for each set of values included in the sets of realistic parameter values for LPM 205. For the set of realistic values of LPM parameters $\mathbf{205}_i$, the loudspeaker parameter estimation system 110 delivers the input stimulus 115 to the LPM 210, and the LPM 210 generates a lumped parameter model (LPM) response $\mathbf{230}_i$. In this fashion, the loudspeaker parameter estimation system 110 produces numerous data points, where each data point represents the LPM response 230 to a different set of parameters values for the LPM 210. For example, and without limitation, in one embodiment, if the number of sets included in the sets of realistic parameter values for LPM 205 were 1000, then the number of LPM responses 230 would be 1000. Further, in such an embodiment, and without limitation, if the number of different stimuli included in the input stimulus 115 was 100, then the total number of different outputs included in the 1000 LPM responses 230 would be 100,000.

As shown, the feature extraction subsystem 150 receives the LPM responses $\mathbf{230}_1$-$\mathbf{230}_N$ and the input stimulus 115. More specifically, for the set of realistic parameter values for LPM $\mathbf{205}_i$, the feature extraction subsystem 150 receives the LPM response $\mathbf{230}_i$ and the corresponding input stimulus 115. Subsequently, the feature extraction subsystem 150 operates on the transfer function that describes the relationship between the input stimulus 115 and the LPM response $\mathbf{230}_i$. More specifically, the feature extraction subsystem 150 is configured to convert dynamical information included in this transfer function into the static features $\mathbf{155}_i$.

The feature extraction subsystem 150 may be implemented in any technically feasible fashion. In the embodiment shown in FIG. 2, the feature extraction subsystem 150 includes multiple, separate recurrent neural networks (RNNs) 260. The feature extraction subsystem 150 trains the RNN $\mathbf{260}_i$. to generate the LPM response $\mathbf{230}_i$ for the set of realistic parameter values for LPM $\mathbf{205}_i$ given the input stimulus 115. For example, and without limitation, in one embodiment, if the number of sets included in the sets of realistic parameter values for LPM 205 were 1000, then the number of RNNs 260 included in the feature extraction subsystem 150 would be 1000. After training, the static parameter values for each of the RNNs 260 accurately represent dynamical system information that relates the input stimulus 115 and the LPM response 230 for a different set of parameters values for the LPM 210. Accordingly, for each of the RNNs 260, the loudspeaker parameter estimation system 110 sets the static features $\mathbf{155}_i$ to the static values of the parameters of the RNN $\mathbf{260}_i$.

The loudspeaker parameter estimation system 110 then trains the parameter estimation neural network (NN) 160 based on the static features 155 and the sets of realistic parameter values for LPM 205. Upon receiving the static features $\mathbf{155}_i$, the parameter estimation NN 160 generates the estimated lumped parameter model (LPM) parameters $\mathbf{190}_i$. The parameter error calculator 270 receives the estimated LPM parameters $\mathbf{190}_i$ and the set of parameters values for the LPM 210 and generates the parameter error $\mathbf{275}_i$—the difference between the estimated lumped parameter model (LPM) parameters $\mathbf{190}_i$ and the set of realistic parameter values for LPM $\mathbf{205}_i$. As the parameter estimation NN 160 processes the static features 155, the parameter estimation NN 160 "learns"—iteratively reducing the parameter error 275 and, thereby, improving the mapping between the static features 155 and the estimated LPM parameters 190.

The parameter estimation NN 260 (also referred to herein as the NN model) may be implemented in any technically correct fashion. For instance, and without limitation, the parameter estimation NN 260 could implement a cascade correlation neural network architecture, a recurrent cascade neural network architecture, a recurrent neural network architecture, a MultiLayer Perceptron neural network architecture, or any other type of artificial learning architecture. Further, the parameter estimation NN 260 may "learn" in any manner that is consistent with the neural network architecture implemented by the parameter estimation NN 260. For example, and without limitation, the parameter estimation NN 260 could be configured to minimize a least squares error cost function.

In some embodiments, the loudspeaker parameter estimation system 110 trains multiple parameter estimation NNs 260 and then selects the parameter estimation NN 260 that minimizes the parameter error 275. Each of these multiple parameter estimation NNs 260 may be based on a different architecture.

Figure 3:
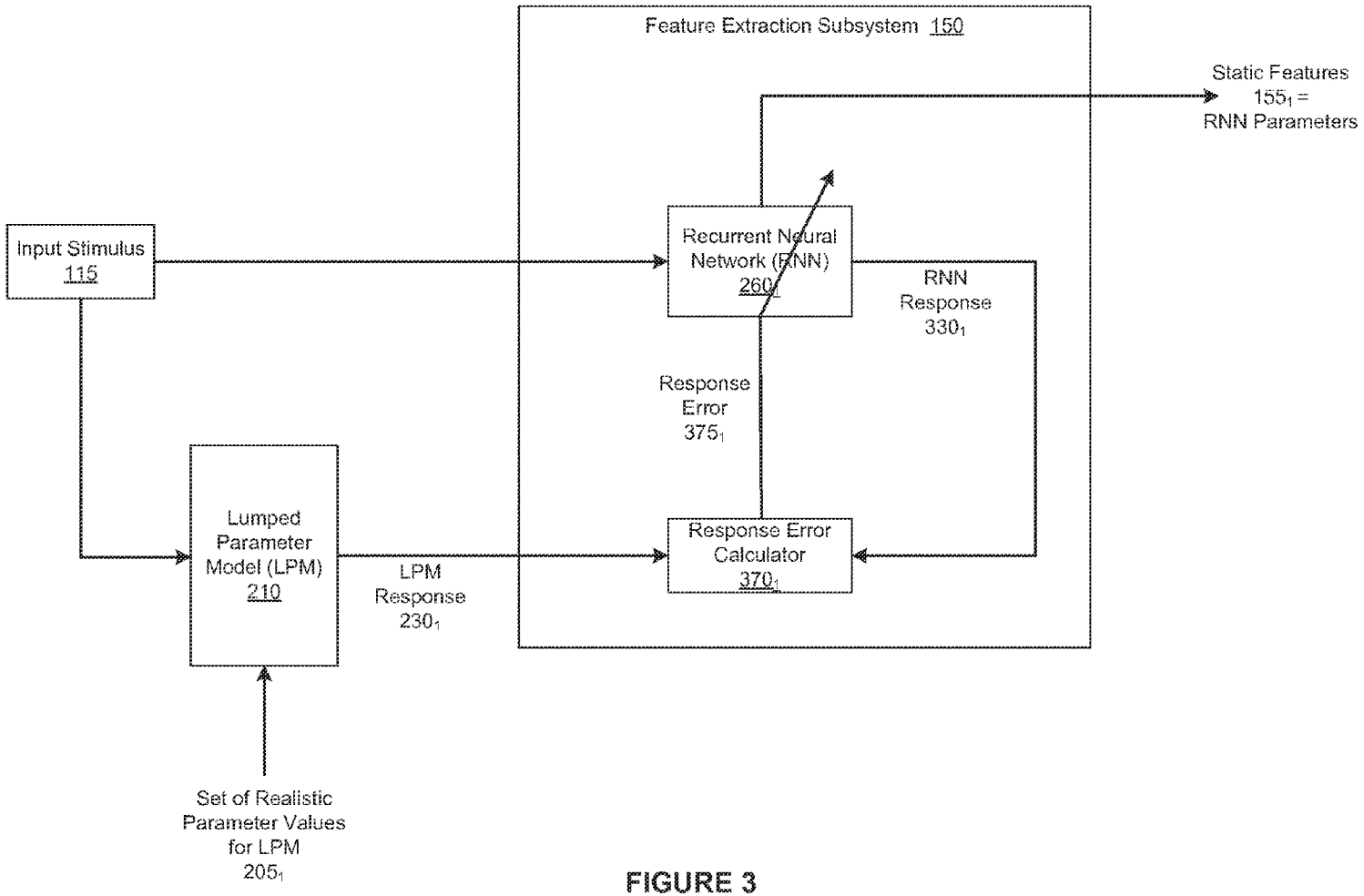
FIG. 3 is a more detailed illustration of the feature extraction subsystem of FIG. 2 showing how to train the recurrent neural network, according to various embodiments.

FIG. 3 is a more detailed illustration of the feature extraction subsystem 150 of FIG. 2 showing how to train the recurrent neural network $\mathbf{260}_1$, according to various embodiments. As shown, the feature extraction subsystem 150 includes, without limitation, the recurrent neural network (NN) $\mathbf{260}_1$, and a response error calculator $\mathbf{370}_1$. Although not shown in FIG. 3, the feature extraction subsystem 150 includes any number of RNN 260 and any number of response error calculators 370.

As shown, the feature extraction subsystem 150 trains the RNN $\mathbf{260}_1$ to generate the LPM response $\mathbf{230}_1$ for the set of realistic parameter values for LPM $\mathbf{205}_1$, given the input stimulus 115. After training, the static parameter values for the RNN $\mathbf{260}_1$ reliably represent dynamical system information that relates the input stimulus 115 and the LPM response $\mathbf{230}_1$ for the set of realistic parameter values for LPM $\mathbf{205}_1$. Accordingly, the loudspeaker parameter estimation system 110 sets the static features $\mathbf{155}_1$ to the static values of the parameters of the RNN $\mathbf{260}_1$.

In operation, upon receiving the LPM response $\mathbf{230}_1$, the RNN $\mathbf{260}_1$ generates a recurrent neural network (RNN) response $\mathbf{330}_1$. The response calculator 370 receives the RNN response $\mathbf{330}_1$ and the LPM response $\mathbf{230}_1$ and generates the response error $\mathbf{375}_i$—the difference between the RNN response $\mathbf{330}_1$ and the LPM response $\mathbf{230}_1$. As the RNN $\mathbf{260}_1$ executes, the RNN $\mathbf{260}_1$ "learns"—iteratively reducing the response error 375 and, thereby, improving the mapping between the LPM response $\mathbf{230}_1$ and the static features $\mathbf{155}_1$. Advantageously, because the feature extraction subsystem 150 decreases the dimensionality of the input to the parameter estimation NN 260 while retaining the relevant features, the desired accuracy for the estimated LPM parameters 190 may be attained using parameter estimation NNs 260 of relatively low complexity.

Figure 4:
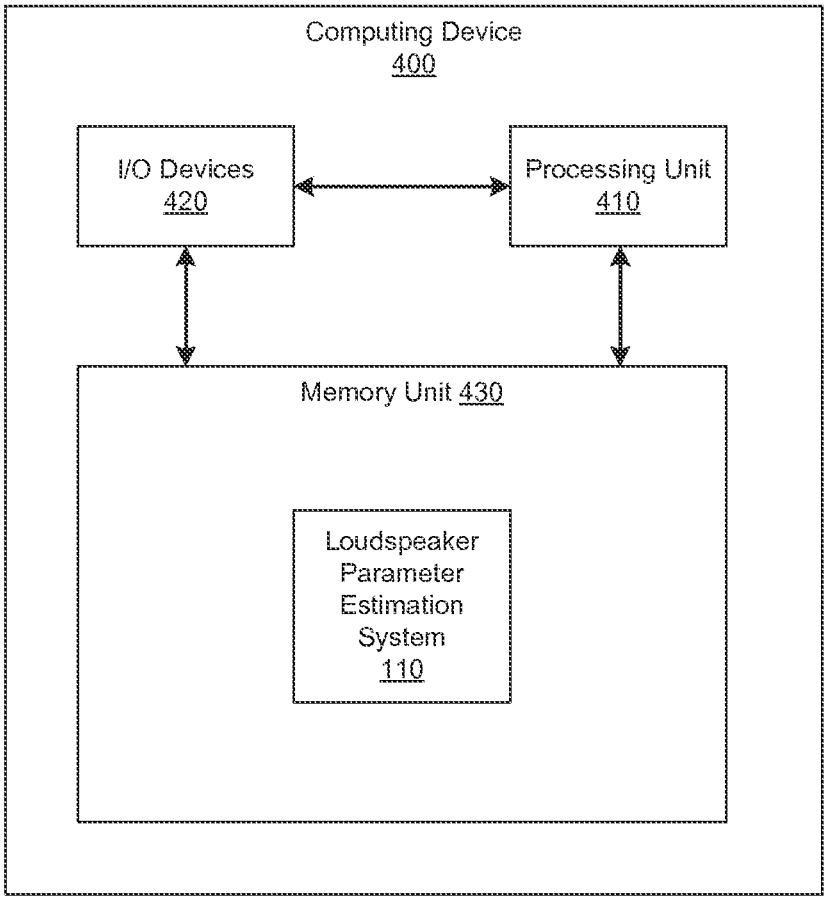
FIG. 4 illustrates a computing device in which one or more aspects of the loudspeaker parameter estimation system of FIG. 1 may be implemented, according to various embodiments.

FIG. 4 illustrates a computing device 400 in which one or more aspects of the loudspeaker parameter estimation system 110 of FIG. 1 may be implemented, according to various embodiments. The computing device 400 may be any type of device capable of executing application programs including, and without limitation, application programs included in the loudspeaker parameter estimation system 110. For instance, and without limitation, the computing device 400 may be a laptop, a tablet, a smartphone, etc. As shown, the computing device 400 includes, without limitation, a processing unit 410, input/output (I/O) devices 420, and a memory unit 430.

The processing unit 410 may be implemented as a central processing unit (CPU), digital signal processing unit (DSP), graphics processor unit (GPU), and so forth. Among other things, and without limitation, the processing unit 410 executes the feature extraction subsystem 150 and the parameter estimation neural network 160. The I/O devices 420 may include input devices, output devices, and devices capable of both receiving input and providing output. The memory unit 430 may include a memory module or collection of memory modules. As shown, the loudspeaker parameter estimation system 110 is included in the memory unit 430.

The computing device 400 may be implemented as a stand-alone chip, such as a microprocessor, or as part of a more comprehensive solution that is implemented as an application-specific integrated circuit (ASIC), a system-on-a-chip (SoC), and so forth. Generally, the computing device 400 may be configured to coordinate the overall operation of a computer-based system, such as a loudspeaker computer-aided development system. In other embodiments, the computing device 400 may be coupled to, but separate from the computer-based system. In such embodiments, the computer-based system may include a separate processor that transmits data, such as the input stimulus 115, to the computing device 400, which may be included in a consumer electronic device, such as a personal computer, and the like. However, the embodiments disclosed herein contemplate any technically feasible system configured to implement the functionality including in various components of the loudspeaker parameter estimation system 110 in any combination.

Figure 5:
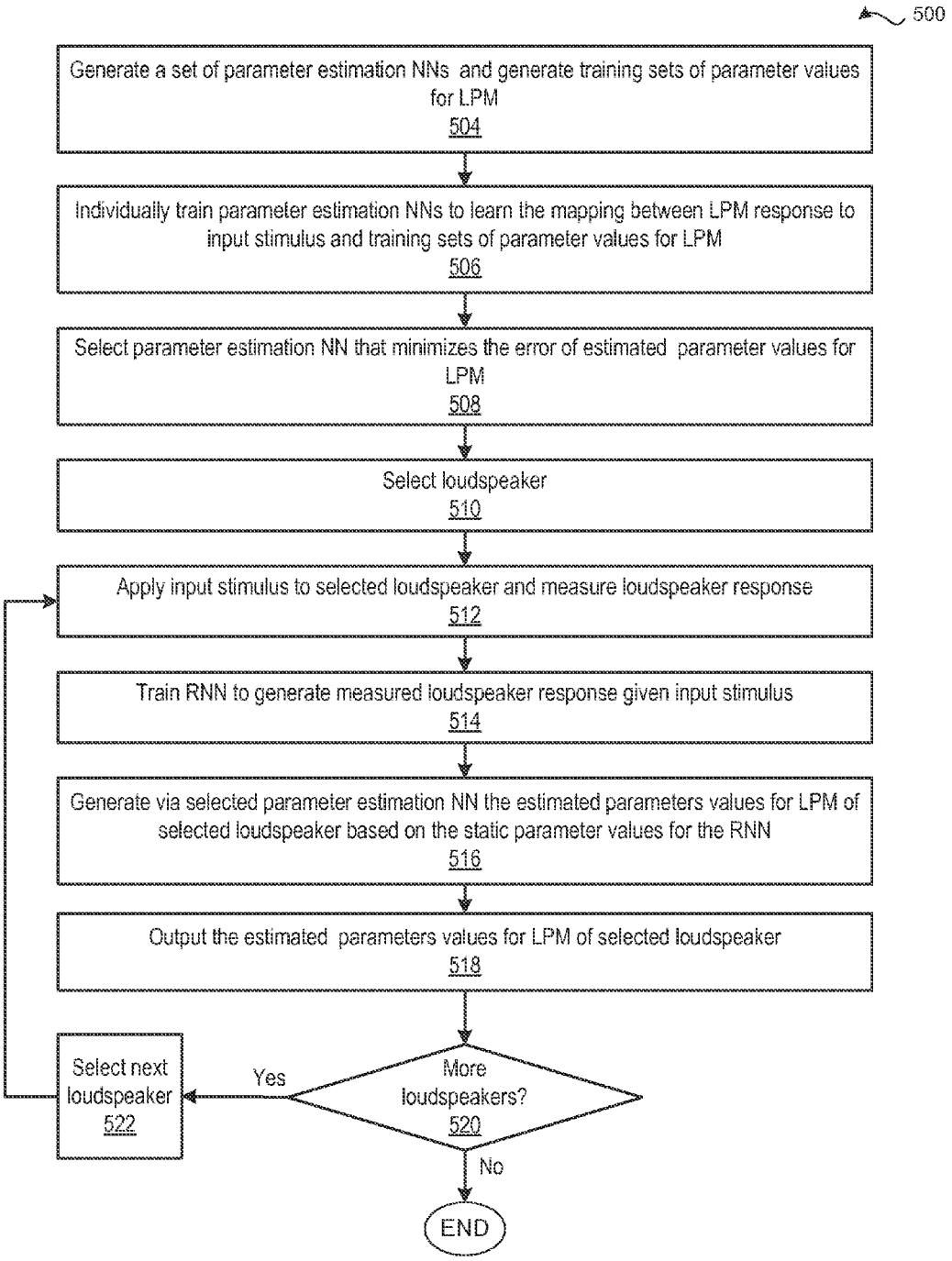
FIG. 5 is a flow diagram of method steps for estimating parameter values for a lumped parameter model (LPM) of a loudspeaker, according to various embodiments.

FIG. 5 is a flow diagram of method steps for estimating parameter values for a lumped parameter model (LPM) of a loudspeaker, according to various embodiments. Although the method steps are described in conjunction with the systems of FIGS. 1-4, persons skilled in the art will understand that any system configured to implement the method steps, in any order, falls within the scope of the present invention.

As shown, a method 500 begins at step 504, where the loudspeaker parameter estimation system 110 generates a set of parameter estimation neural networks (NNs) 160 and generates training sets of parameter values for LPM 210—the sets of realistic parameter values for LPM 205. At step 506, the loudspeaker parameter estimation system 110 individually trains each of the parameter estimation NNs 160 to learn the mapping between the LPM response 230 to the input stimulus 115 and the sets of realistic parameter values for LPM 205. The loudspeaker parameter estimation system 110 may train the parameter estimation NNs 160 in any technically feasible fashion. For example, and without limitation, the loudspeaker parameter estimation system 110 may perform the steps detailed in FIG. 6.

At step 508, the loudspeaker parameter estimation system 110 compares the accuracy of the estimated LPM parameters 190 generated via each of the parameter estimation NNs 160 to the corresponding set of realistic values of the LPM parameters 205. The loudspeaker parameter system 100 then selects the parameter estimation NN 160 that generates the estimated LPM parameters 190 that best match the set of realistic values of the LPM parameters 205.

At step 510, the loudspeaker parameter estimation system 110 selects the loudspeaker 120. At step 512, the loudspeaker parameter estimation system 110 applies the input stimulus 115 to the selected loudspeaker 120, senses the loudspeaker output 125 via the sensor 132, and generates the measured loudspeaker response 135. At step 512 the loudspeaker parameter estimation system 110 trains a loudspeaker-specific recurrent neural network 260 to generate the measured loudspeaker response 135 give the input stimulus 115. After training, the static parameters values for the RNN 260 reliably represent dynamical system information that relates the input stimulus 115 and the measured loudspeaker response 135. Accordingly, the loudspeaker parameter estimation system 110 sets the static features 155 to the static values of the parameters of the RNN 260.

At step 516, the loudspeaker parameter estimation system 110 generates via the selected parameter estimation NN 160 the estimated LPM parameters 190 based on the static features 155. Advantageously, when the estimated LPM parameters 190 are used as values of the parameters of the LPM 210, the LPM 210 accurately models the behavior of the loudspeaker 120. At step 520, the loudspeaker parameter estimation system 110 determines whether there are any more loudspeakers 120 to be evaluated. If, at step 520, the loudspeaker parameter estimation system 110 determines that there are not any more loudspeakers 120 to be evaluated, then the method 500 terminates.

If, at step 520, the loudspeaker parameter estimation system 110 determines that there are more loudspeakers 120 to be evaluated, then the method 500 proceeds to step 522. At step 522, the loudspeaker parameter estimation system 110 selects the next loudspeaker 120 and the method 500 returns to step 512. The loudspeaker parameter estimation system 110 continues in this fashion, performing steps 512-522 until the loudspeaker parameter estimation system 110 has evaluated all of the loudspeakers 120.

In general, each of the steps of method 500 may be performed in any technically feasible fashion, in any order, and in any combination. For example, and without limitation, as part of evaluating multiple neural network architectures, the loudspeaker parameter estimation system 110 may be configured to train each of the parameter estimation NNs 160 (step 506) by performing the steps detailed in FIG. 6.

Figure 6:
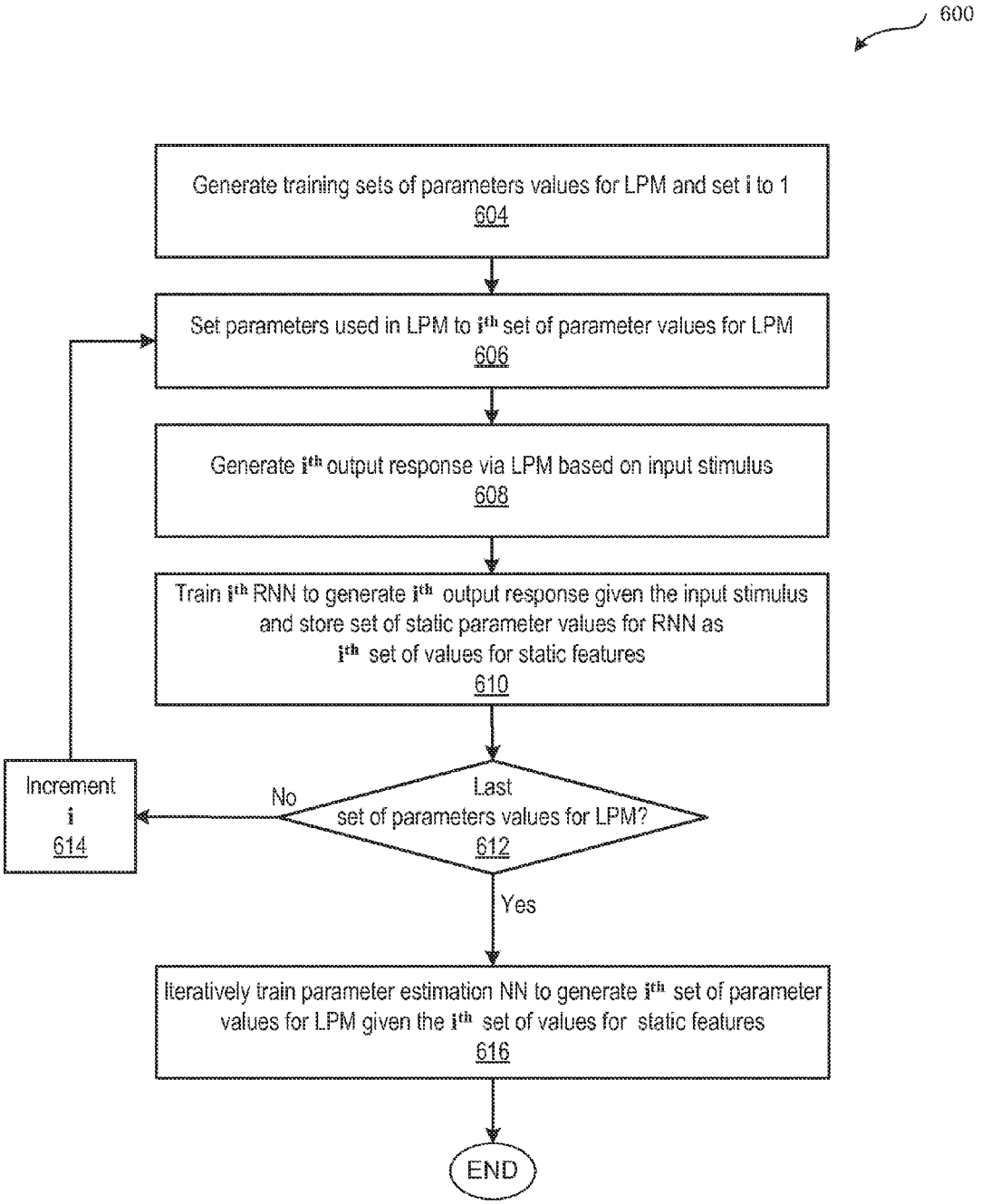
FIG. 6 is a flow diagram of method steps for generating a neural network that estimates parameter values for a lumped parameter model (LPM) of a loudspeaker, according to various embodiments.

FIG. 6 is a flow diagram of method steps for generating a neural network that estimates parameter values for a lumped parameter model (LPM) of a loudspeaker, according to various embodiments. Although the method steps are described in conjunction with the systems of FIGS. 1-4, persons skilled in the art will understand that any system configured to implement the method steps, in any order, falls within the scope of the present invention.

As shown, a method 600 begins at step 604, where the loudspeaker parameter estimation system 110 generates training sets of parameter values for the LPM 210—the sets of realistic parameter values for LPM 205. As part of step 604, the loudspeaker parameter estimation system 110 initializes the index "i" to 1. At step 606, the loudspeaker parameter estimation system 110 sets the parameters values for the LPM 210 to the set of realistic parameter values for LPM $\mathbf{205}_i$. At step 608, the loudspeaker parameter estimation system 110 generates via the LPM 210 the LPM response $\mathbf{230}_i$ to the input stimulus 115.

At step 610, the loudspeaker parameter estimation system 110 trains the RNN $\mathbf{260}_i$ to generate the LPM response $\mathbf{230}_i$ given the input stimulus 115. After training, the static parameter values for the RNN $\mathbf{260}_i$ accurately represent dynamical system information that relates the input stimulus 115 and the LPM response $\mathbf{230}_i$. Subsequently, the loudspeaker parameter estimation system 110 sets the static features $\mathbf{155}_i$ to the static values of the parameters of the RNN $\mathbf{260}_i$.

At step 612, the loudspeaker parameter estimation system 110 determines whether the set of realistic parameter values for LPM $\mathbf{205}_i$ is the last of the sets of realistic parameter values for LPM 205. If, at step 612, the loudspeaker parameter estimation system 110 determines that the set of realistic parameter values for LPM $\mathbf{205}_i$ is the last of the sets of realistic parameter values for LPM 205, then the method 600 proceeds directly to step 616.

At step 612, if the loudspeaker parameter estimation system 110 determines that the set of realistic parameter values for LPM $\mathbf{205}_i$ is not the last of the sets of realistic parameter values for LPM 205, then the method 600 proceeds to step 614. At step 614, the loudspeaker parameter estimation system 110 increments the index i and the method 600 returns to step 608, where the loudspeaker estimation system 100 trains the next RNN 260. The loudspeaker parameter estimation system 110 continues in this fashion, performing steps 606-614 until the loudspeaker parameter estimation system 110 has trained the RNNs 260 and generated the static features 155 for each of the sets of realistic parameter values for LPM 205.

At step 616, the loudspeaker parameter estimation system 110 iteratively trains the parameter estimation NN 160. More specifically, the loudspeaker parameter estimation system 110 trains the parameter estimation NN 160 to accurately estimate the set of realistic parameter values for LPM $\mathbf{205}_i$ given the static features $\mathbf{155}_i$ In this fashion, the parameter estimation NN 160 learns the mapping from the static features 155 to the estimated LPM parameters 190, and the method 600 terminates.

In sum, the disclosed techniques enable effective analysis of aspects of loudspeaker behavior using a lumped parameter model (LPM). Notably, a loudspeaker parameter estimation system "trains" a neural network (NN) to accurately and efficiently estimate values of the parameters of the LPM of a loudspeaker based on a measured response of the loudspeaker to an input stimulus. As part of training the parameter estimation NN the loudspeaker parameter estimation system generates estimated responses via the LPM using multiple sets of parameters values for the LPM (representing different loudspeakers) and a training input stimulus. For each set of values of the parameters, the parameter estimation subsystem then determines a transfer function of the LPM—a relationship between the training input stimulus and the estimated response corresponding to the set of values. Subsequently, the parameter estimation subsystem trains the parameter estimation NN to map each of the transfer functions of the LPM to the corresponding set of values of the parameters of the LPM.

At least one advantage of the disclosed approaches is that they enable both more efficient and more accurate analysis of nonlinear aspects of loudspeaker systems relative to conventional techniques. By exploiting the ability of neural networks to effectively model complex nonlinear mappings, the parameter estimation subsystem generates estimated values that, when assigned to the parameters used in the LPM, accurately reproduce measured responses of loudspeakers. Consequently, the estimated values of the parameters may be reliably used to analyze and improve loudspeaker designs and perform nonlinear correction of loudspeakers with more accuracy than typically attainable using values of the parameters used in the LPM generated via conventional estimation techniques.

The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments.

Aspects of the present embodiments may be embodied as a system, method or computer program product. Accordingly, aspects of the present disclosure may take the form of an entirely hardware embodiment, an entirely software embodiment (including firmware, resident software, microcode, etc.) or an embodiment combining software and hardware aspects that may all generally be referred to herein as a "circuit," "module" or "system." Furthermore, aspects of the present disclosure may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Aspects of the present disclosure are described above with reference to flowchart illustrations and/or block diagrams of methods, apparatus (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, enable the implementation of the functions/acts specified in the flowchart and/or block diagram block or blocks. Such processors may be, without limitation, general purpose processors, special-purpose processors, application-specific processors, or field-programmable The flowchart and block diagrams in the figures illustrate the architecture, functionality, and operation of possible implementations of systems, methods and computer program products according to various embodiments of the present disclosure. In this regard, each block in the flowchart or block diagrams may represent a module, segment, or portion of code, which comprises one or more executable instructions for implementing the specified logical function (s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The invention has been described above with reference to specific embodiments. Persons of ordinary skill in the art, however, will understand that various modifications and changes may be made thereto without departing from the broader spirit and scope of the invention as set forth in the appended claims. For example, and without limitation, although many of the descriptions herein refer to specific types of audiovisual equipment and sensors, persons skilled in the art will appreciate that the systems and techniques described herein are applicable to other types of performance output devices (e.g., lasers, fog machines, etc.) and sensors. The foregoing description and drawings are, accordingly, to be regarded in an illustrative rather than a restrictive sense.

While the preceding is directed to embodiments of the present disclosure, other and further embodiments of the disclosure may be devised without departing from the basic scope thereof, and the scope thereof is determined by the claims that follow.

What is claimed is:

1. A computer-implemented method for estimating a set of parameter values for a lumped parameter model of a loudspeaker, the method comprising:

receiving an audio input signal and a measured response of a loudspeaker that corresponds to the audio input signal; and generating via a first neural network model a first set of parameter values for the lumped parameter model of the loudspeaker based on the audio input signal and the measured response, wherein the behavior of the first neural network model is tuned according to a plurality of model responses generated via the lumped parameter model based on varying sets of parameter values.

2. The method of claim 1, wherein the varying sets of parameter values include a first training set of parameter values and a second training set of parameter values, and further comprising, prior to receiving the measured response of the loudspeaker:

generating via the lumped parameter model a first model response based on a first training input signal and the first training set of parameter values; and generating via the lumped parameter model a second model response based on a second training input signal and the second training set of parameter values.

3. The method of claim 2, wherein the first training input signal and the second training input signal comprise the same signal.

4. The method of claim 1, further comprising, prior to receiving the measured response of the loudspeaker:

training a second neural network model and a third neural network based on the varying sets of parameter values;

determining that a second set of parameters generated via the second neural network model is more accurate than a third set of parameters generated via the third neural network model; and in response, setting the first neural network model to the second neural network model.

5. The method of claim 4, wherein an architecture of the second neural network model and an architecture of the third neural network model differ.

6. The method of claim 1, wherein the varying sets of parameter values include a first training set of parameter values, and further comprising, prior to receiving the measured response of the loudspeaker:

generating via the lumped parameter model a first model response based on a first training input signal and the first training set of parameter values;

performing one or more feature extraction operations that convert dynamic information related to at least one of the first model response and the first training input signal into static information; and training the first neural network model based on the static information and the first training set of parameter values.

7. The method of claim 1, wherein the varying sets of parameter values include a first training set of parameter values, and further comprising, prior to receiving the measured response of the loudspeaker:

generating via the lumped parameter model a first model response based on a first training input signal and the first training set of parameter values;

training a first recurrent neural network model to generate the first model response based on the first training input signal; and training the first neural network based on a set of static parameter values used in the first recurrent neural network model and the first training set of parameter values.

8. The method of claim 1, wherein generating via the first neural network model comprises:

performing one or more feature extraction operations that convert dynamic information related to at least one of the measured response and the audio input signal into static information; and mapping the static information to the first set of parameter values using the first neural network model.

9. The method of claim 1, wherein generating via the first neural network model comprises:

training a recurrent neural network model to generate the measured response based on the audio input signal;

mapping a set of static parameter values for the recurrent neural network model to the first set of parameter values using the first neural network model.

10. A non-transitory, computer-readable storage medium including instructions that, when executed by a processor, cause the processor to estimate a set of parameter values for a lumped parameter model of a loudspeaker by performing the steps of:

determining a measured response of a loudspeaker corresponding to a sound generated by the loudspeaker based on an audio input signal; and generating via a first neural network model a first set of parameter values for the lumped parameter model of the loudspeaker based on the audio input signal and the measured response, wherein the behavior of the first neural network model is tuned according to a plurality of model responses generated via the lumped parameter model based on varying sets of parameter values.

11. The non-transitory, computer-readable storage medium of claim 10, further comprising, prior to receiving the measured response of the loudspeaker, generating via the lumped parameter model the plurality of model responses based on the varying sets of parameter values.

12. The non-transitory, computer-readable storage medium of claim 10, wherein the varying sets of parameter values includes a first training set of parameter values and further comprising, prior to receiving the measured response of the loudspeaker:

generating via the lumped parameter model a first model response based on a first training input signal and the first training set of parameter values;

performing one or more feature extraction operations that convert dynamic information related to at least one of the first model response and the first training input signal into static information; and training the first neural network model based on the static information and the first training set of parameter values.

13. The non-transitory, computer-readable storage medium of claim 12, wherein the one or more feature extraction operations include at least one of a short-time Fourier transform, a cepstral transform, a wavelet transform, a Hilbert transform, a linear/nonlinear principal component analysis, and a distortion analysis.

14. The non-transitory, computer-readable storage medium of claim 10, wherein the varying sets of parameter values includes a first training set of parameter values, and further comprising, prior to receiving the measured response of the loudspeaker:

generating via the lumped parameter model a first model response based on a first training input signal and the first training set of parameter values;

training a first recurrent neural network model to generate the first model response based on the first training input signal;

training the first neural network based on a set of static parameter values used in the first recurrent neural network model and the first training set of parameter values.

15. The non-transitory, computer-readable storage medium of claim 10, wherein generating via the first neural network model comprises:

performing one or more feature extraction operations that convert dynamic information related to at least one of the measured response and the audio input signal into static information; and mapping the static information to the first set of parameter values using the first neural network model.

16. The non-transitory, computer-readable storage medium of claim 10, wherein generating via the first neural network model comprises:

training a recurrent neural network model to generate the measured response based on the audio input signal; and mapping a set of static parameter values for the recurrent neural network model to the first set of parameter values using the first neural network model.

17. The non-transitory, computer-readable storage medium of claim 10, wherein the first neural network model includes at least one of a cascade correlation neural network, a recurrent cascade neural network, a recurrent neural network, and a MultiLayer Perceptron neural network.

18. The non-transitory, computer-readable storage medium of claim 10, further comprising generating a first training set of parameter values included in the varying sets of parameter values using an adaptive algorithm.

19. A computing device, comprising:

a memory that includes a loudspeaker parameter estimation subsystem; and a processor coupled to the memory and, upon executing the loudspeaker parameter estimation subsystem, is configured to:

receive an audio input signal and a measured response of a loudspeaker that corresponds to the audio input signal, and generate via a neural network model a first set of parameter values for a lumped parameter model of the loudspeaker based on the audio input signal and the measured response, wherein the behavior of the neural network model is tuned according to a plurality of model responses generated via the lumped parameter model based on varying sets of parameter values.

20. The computing device of claim 19, wherein a training set of parameter values included in the varying sets of parameter values comprises a Klippel parameter set for a transducer.

* * * * *